US009297280B2

(12) United States Patent
Kreis

(10) Patent No.: US 9,297,280 B2
(45) Date of Patent: Mar. 29, 2016

(54) METHOD AND APPARATUS FOR UTILIZING THE EXHAUST HEAT FROM INTERNAL COMBUSTION ENGINE

(76) Inventor: Reinhard Kreis, Magdeburg (DE)

( * ) Notice: Subject to any disclaimer, the term of this patent is extended or adjusted under 35 U.S.C. 154(b) by 673 days.

(21) Appl. No.: 12/592,039

(22) Filed: Nov. 17, 2009

(65) Prior Publication Data

US 2010/0122672 A1 May 20, 2010

(30) Foreign Application Priority Data

Nov. 17, 2008 (DE) ..... 10 2008 057 691

(51) Int. Cl.
*F01P 7/14* (2006.01)
*F02G 3/00* (2006.01)
*F01K 23/06* (2006.01)

(52) U.S. Cl.
CPC ..... *F01K 23/065* (2013.01)

(58) Field of Classification Search
CPC ..... F01K 23/065; F01K 23/10; F01K 25/10; F01K 25/08; F01K 9/003; F01K 23/04; F01K 7/22; F01K 9/00; F02G 5/04; F02G 2260/00; F02G 5/02; F02G 5/00; F02G 2262/00; F28D 15/0266
USPC ..... 123/41.08, 41.09, 41.15, 41.2, 41.21, 123/41.22, 41.26
See application file for complete search history.

(56) References Cited

U.S. PATENT DOCUMENTS 3,686,867 A * 8/1972 Hull ..... 60/667
3,772,879 A * 11/1973 Engdahl ..... 60/671
3,844,262 A * 10/1974 Dieges ..... 123/567
4,201,058 A * 5/1980 Vaughan ..... 60/618
4,420,373 A * 12/1983 Egosi ..... 202/173
4,576,005 A * 3/1986 Force ..... 60/618
4,611,557 A * 9/1986 Hierzenberger ..... 123/25 B
6,230,669 B1 * 5/2001 Evans ..... 123/41.5
6,732,525 B2 * 5/2004 Endoh et al. ..... 60/618
7,021,059 B2 * 4/2006 Shinohara et al. ..... 60/618
7,069,884 B2 * 7/2006 Baba et al. ..... 123/41.82 R
7,191,738 B2 * 3/2007 Shkolnik ..... 123/19
7,249,459 B2 * 7/2007 Hisanaga et al. ..... 60/641.1
2006/0191678 A1 * 8/2006 Sato et al. ..... 165/271
2007/0056284 A1 * 3/2007 Kalina ..... 60/618
2007/0144464 A1 * 6/2007 Muller ..... 123/41.29
2007/0204623 A1 * 9/2007 Rollins ..... 60/772
2007/0227472 A1 * 10/2007 Takeuchi et al. ..... 123/41.19
2007/0235164 A1 * 10/2007 Miyagawa et al. ..... 165/104.14
2007/0245737 A1 * 10/2007 Inaba et al. ..... 60/670
2008/0034729 A1 * 2/2008 Tafas ..... 60/39.182
2008/0087238 A1 * 4/2008 Held et al. ..... 123/41.48

(Continued)

FOREIGN PATENT DOCUMENTS

DE 19916676 11/2000
DE 19916678 C1 11/2000
DE 102008057691 A1 5/2010

(Continued)

*Primary Examiner* — Lindsay Low
*Assistant Examiner* — Long T Tran
(74) *Attorney, Agent, or Firm* — Bergman & Song LLP; Michael Bergman

(57) ABSTRACT

A method of and apparatus for improving the efficiency of an internal combustion engine by using coolant vapor fed to a component converting the vapor energy to mechanical energy for supplementing the power of the engine when the engine is operating in a first state and bypassing the component when the engine is operating in a state other than its first state.

21 Claims, 1 Drawing Sheet

(56) References Cited

U.S. PATENT DOCUMENTS

| | | | | |
|---|---|---|---|---|
| 2008/0204623 | A1* | 8/2008 | Tanaka | 349/58 |
| 2008/0257301 | A1* | 10/2008 | Hotta et al. | 123/253 |
| 2009/0071156 | A1* | 3/2009 | Nishikawa et al. | 60/660 |
| 2009/0211253 | A1* | 8/2009 | Radcliff et al. | 60/670 |

FOREIGN PATENT DOCUMENTS

| | | | |
|---|---|---|---|
| DE | 102009060343 | A1 | 6/2011 |
| IT | MI20091887 | A1 | 5/2010 |
| WO | WO03048529 | | 6/2003 |
| WO | WO03048529 | A1 | 6/2003 |

* cited by examiner

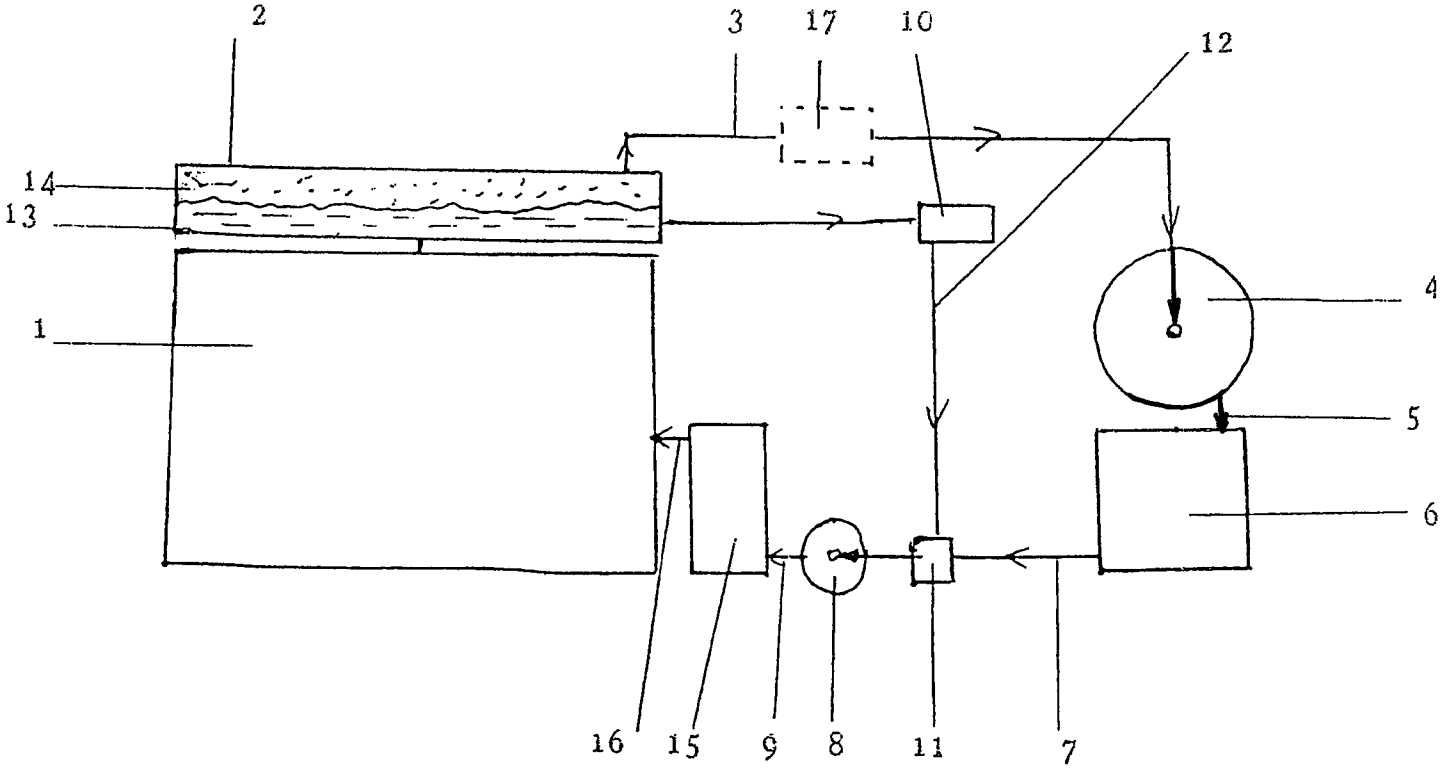
4
5
6
12
7
10
11
17
8
3
9
15
16
2
14
13
1

METHOD AND APPARATUS FOR UTILIZING THE EXHAUST HEAT FROM INTERNAL COMBUSTION ENGINE

CROSS-REFERENCE TO RELATED APPLICATIONS

The present application claims priority under the Paris convention for the protection of industrial property to German Patent Application number: DE 10 2008 057 691.3 having a filing date of Nov. 17, 2008, the disclosure of which is herewith incorporated by reference in its entirety.

FIELD OF THE INVENTION

The invention, in general, relates to a method and to an apparatus for utilizing the exhaust heat from an internal combustion engine and, more particularly, to a method and apparatus for improving the energy balance of liquid-cooled internal combustion engines by means of supplemental or auxiliary components.

BACKGROUND

It has been known that about 30% of the energy intake of an internal combustion engine is wasted and dissipated to the environment without being otherwise used. At best, such waste energy is partially utilized for heating purposes. Exhaust gas turbo chargers are among the known supplemental or auxiliary components which by means of a gas turbine make use of the exhaust gas flow to bring about a significant improvement in the efficiency of internal combustion engines.

Furthermore, it has been known to feed the coolant vapor of an internal combustion engine to a turbine; but regulating the coolant circulation and maintaining a stable operating condition have been found to be problematic, particularly during start-up and shut-down phases of the system. Moreover, the safety of the operating system is by no means assured (WO 03/048529 A1). It has also been known to conduct, parallel to the coolant circuit, evaporating cooling liquid into a turbine and to maintain coolant liquid circulation by means of two compressors. However, such a system is technically complex in terms of its manufacture, installation and maintenance (DE 199 16 676 C1).

SUMMARY OF THE INVENTION

In its various embodiments, the present invention makes use of the thermal energy inherent in the coolant liquid of an internal combustion engine so as to improve the efficiency thereof. According to certain aspects of the invention, flawless operation of an internal combustion engine is ensured by controlling a flow of coolant vapor and coolant liquid.

In accordance with the invention, these benefits are realized by generating vapor by evaporation of coolant liquid in coolant liquid channels of a running internal combustion engine and by conducting the coolant liquid vapor, either in an open circuit or in a closed circuit of coolant liquid and vapor, to a vapor turbine followed, after passing through the vapor turbine, by condensing the vapor to coolant liquid in a condenser and thereafter feeding the coolant liquid back into the coolant-vapor-circuit with a coolant pump, the power of the vapor turbine being used either for driving auxiliary components or being transmitted directly to the drive train of the internal combustion engine. Preferably, the vapor is initially collected in a vapor collector.

In order to insure proper functioning of the method even during start-up and shut-down phases of operating an internal combustion engine, suitable controls are provided for regulating the flow of coolant liquid between its emission from the coolant liquid channels to a coolant liquid cooler or radiator, by feeding it to the cooler or radiator by way of a bypass disposed parallel to the vapor conduit, vapor turbine and vapor condenser, for reducing the temperature of the coolant liquid to that of a preferred operating temperature of the internal combustion engine.

The apparatus for practicing the method comprises an internal combustion engine provided with coolant liquid channels, coolant liquid conduits and vapor conduits as well as a vapor turbine, a vapor condenser, a coolant liquid bypass, a coolant liquid pump and coolant liquid cooler (radiator) as well as suitable controls for regulating the flow of coolant liquid and vapor, all such components being pressure proof in excess of 2 bar. Advantageously, the apparatus also comprises a vapor collector and a pressure equalizing tank for the coolant liquid.

A vapor superheater heated by exhaust gas may be provided in the vapor conduit between the vapor collector and the vapor turbine.

The structural components referred to supra are arranged such that the internal combustion engine, which acts, as a vapor generator, is connected to the vapor turbine by a vapor conduit directly and/or by a vapor collector, the vapor turbine is connected to a vapor condenser directly or by a vapor conduit, the vapor condenser is connected directly or by a vapor conduit and coolant liquid pump to the coolant liquid cooler or radiator which is in turn connected to the coolant liquid channels of the internal combustion engine in a closed coolant liquid vapor circuit.

The coolant liquid bypass conduit extends from the coolant liquid output of the cylinder head of the engine to a connection between the vapor condenser for condensing the coolant vapor emitted from the vapor turbine and a coolant liquid pump for feeding the condensate back to the coolant liquid vapor circuit and may be provided with any devices necessary for the proper functioning of the internal combustion engine such as, for instance, monitoring or measuring, indicating, controlling, shut-off and other auxiliary means for the start-up and shut-down phases of the internal combustion engine. Preferably, a vapor collector is provided in the vapor conduit at the input of the vapor turbine.

The efficiency of an internal combustion engine equipped in accordance with the invention has been found to exceed 60%. The technological outlay for practicing the method in accordance with the invention is, therefore, thought to be absolutely justified.

DESCRIPTION OF THE DRAWING

The novel features which are considered to be characteristic of the invention have been set forth with particularity in the appended claims. The invention itself, however, in respect of its structure, construction and lay-out as well as manufacturing techniques, together with other objects and advantages thereof, will be best understood from the following description of preferred embodiments when read in connection with the sole FIGURE of the appended drawing which schematically depicts an arrangement of a diesel engine coolant liquid vapor circuit in accordance with the invention.

DETAILED DESCRIPTION

A housing 1 of a diesel engine, schematically shown in the drawing, is structurally designed such that coolant liquid channels thereof are capable of withstanding pressures up to 5 bar in excess of atmospheric pressure. This corresponds to a boiling point of the coolant liquid of about 150° C. The diesel engine is laid out such that, when it is running, the temperature of coolant liquid 13 is about 140° C. at the hottest section of the cylinder head, and the vapor pressure is at about 4 bar. At this temperature and pressure the coolant liquid is evaporating.

Vapor 14 of the coolant liquid 13 is conducted from a vapor collection chamber 2 through a vapor conduit 3 to a converter such as a vapor turbine 4 where the thermal energy of the vapor 14 is transformed into mechanical energy. Optionally, and as indicated in broken lines, a vapor superheater 17, preferably powered by exhaust gas from the diesel engine, may be connected to the conduit 3 at the input side of the vapor turbine 4. The vapor turbine 4 is coupled to a mechanical load such as, for instance, an electric generator (not shown). The vapor 14 emitted from the vapor turbine 4 is fed by an output vapor conduit 5 to a vapor condenser 6, where it is condensed to coolant liquid.

A coolant liquid pump 8 is provided in an output conduit 7 for the condensate of coolant liquid. The coolant liquid pump 8 is adapted for returning the coolant liquid from the condenser 6 through a controlled valve 11 and to the engine housing 1 through a coolant liquid conduit 9 of a closed coolant circuit. A cooler or radiator 15 is connected to coolant liquid conduit 9 between the pump 8 and the engine housing 1 for reducing a temperature of the coolant liquid substantially to or below that of the engine.

In parallel to the circuit thus described, there is provided a bypass 12 connected between the cylinder head 2 of the engine 1 and a control valve 11 disposed in the coolant output conduit 7 of the vapor condenser 6. The bypass 12 is provided with a control unit 10 for selectively causing the valve 11 to switch between states in which coolant liquid flows from either the condenser 6 or directly from the cylinder head 2.

Under the control of the device 10 safe and flawless operation of the diesel engine may be ensured during its start-up and shut-down operational phases or whenever the vapor turbine 4 is not in use. The control unit 10 may, for instance, set the state of the valve 11 in response to the ignition being turned on or off; blocking the flow of coolant liquid from the condenser 6 and opening the flow through the bypass 12 and vice versa. The control unit 10 may also, for instance, set the state of the valve 11 in response to the engine operating temperature having reached a predetermined level. The controlled bypass 12 ensures safe operation of the diesel engine during start-up and shut-down phases. The controlled bypass 12 also ensures proper functioning of the diesel engine in case of a defect in the vapor circuit.

During start-up or shut-down phases of engine operation, or whenever the vapor circuit including the vapor turbine 4 is defective, the valve 11 may block the flow of coolant liquid 13 from the condenser 6 and provide a direct coolant flow connection from and to the engine by way of the cooler 15. Depending upon the type of control unit 10 and valve 11, a gradual change of the state of the valve 11 in response, for instance, to the instantaneous operating temperature of the engine is, of course, possible and within the ambit of the instant invention.

What is claimed is:

1. An engine system comprising:

an engine, said engine having a cooling system, said cooling system being adapted to absorb a quantity of waste heat from said engine to produce a first high temperature gas phase of a coolant and a second high temperature liquid phase of said coolant;

a first subsystem, said first subsystem including a converter and a condenser, said converter being adapted to receive said first high temperature gas phase of said coolant and to produce mechanical energy and a third low temperature gas phase of said coolant, said condenser being adapted to receive said low temperature gas phase of said coolant and to extract heat to produce a fourth high temperature liquid phase of said coolant;

a second subsystem, said second subsystem being adapted to receive said second high temperature liquid phase of said coolant;

a heat exchanger, said heat exchanger being adapted to receive said second high temperature phase of said coolant and said fourth high temperature phase of said coolant, and to extract heat to produce a fifth low temperature phase of said coolant;

a valve system, said valve system being coupled to said first and second subsystems, said valve system being adapted to control a flow of said second and fourth high temperature liquid phases of said coolant to said heat exchanger according to an operational state of said engine, such that said heat exchanger forms an exclusive return path upstream of said engine and downstream of said valve system for said second high temperature phase and said fourth high temperature phase of said coolant.

2. An engine system as defined in claim 1 wherein said valve system comprises:

a valve;

a controller, said controller being coupled to said engine and said valve, said controller being adapted to detect said operational state of said engine and to change a state of said valve responsive to said operational state of said engine.

3. An engine system as defined in claim 2 wherein said state of said valve comprises:

a first binary valve state in which said heat exchanger substantially exclusively receives said second high temperature liquid phase of said coolant during a first time interval; and a second binary valve state in which said heat exchanger substantially exclusively receives said fourth high temperature liquid phase of said coolant during a second time interval.

4. An engine system as defined in claim 2 wherein said state of said valve comprises:

a median valve state in which said heat exchanger receives a combination of said second and fourth high temperature liquid phases of said coolant during a particular time interval.

5. An engine system as defined in claim 1 wherein said operational state of said engine comprises a startup state of said engine during a startup phase.

6. An engine system as defined in claim 1 wherein said operational state of said engine comprises a shutdown state of said engine during a shutdown phase.

7. An engine system as defined in claim 1 wherein said operational state of said engine comprises a normal operational state of said engine during a particular time interval between a startup phase and a shutdown phase of said engine system.

8. An engine system as defined in claim 1 wherein said operational state of said engine comprises a failure mode state of said engine.

9. An engine system as defined in claim 8 wherein said failure mode state of said engine comprises a state of said engine during a time interval when said converter is malfunctioning.

10. An engine system as defined in claim 1 wherein said first subsystem further comprises a vapor superheater, said vapor superheater being coupled to an exhaust system of said engine, said vapor superheater being adapted to receive heat from an exhaust gas of said engine and to elevate a temperature of said first high temperature gas phase of said coolant.

11. An engine system as defined in claim 1 further comprising:

a vapor collector device, said vapor collector device being adapted to receive and segregate said first high temperature gas phase of said coolant and said second high temperature liquid phase of said coolant.

12. An engine system as defined in claim 1 further comprising:

a pump, said pump being adapted to motivate a flow of said coolant through said heat exchanger.

13. An engine system as defined in claim 12 wherein said pump is coupled between an inlet of said heat exchanger and an outlet of said valve system.

14. An engine system as defined in claim 1 wherein said converter is adapted to apply said mechanical energy to a drivetrain of said engine.

15. An engine system as defined in claim 1 wherein said valve is coupled to respective outlets of said first and second subsystems.

16. An engine system as defined in claim 1 wherein said engine comprises a diesel engine.

17. An engine system as defined in claim 1 wherein said converter comprises a turbine.

18. An engine system as defined in claim 1 wherein said heat exchanger comprises a radiator.

19. An engine system comprising:

an engine, said engine having a cooling system, said cooling system being adapted to absorb a quantity of waste heat from said engine to produce both a first high temperature gas phase of a coolant and a second high temperature liquid phase of said coolant within a vapor collection chamber;

a converter and a condenser, said converter being coupled to said vapor collection chamber to receive said first high temperature gas phase of said coolant from said vapor collection chamber, and adapted to receive said first high temperature gas phase of said coolant and to produce mechanical energy and a third low temperature gas phase of said coolant, said condenser being adapted to receive said low temperature gas phase of said coolant and to extract heat to produce a fourth high temperature liquid phase of said coolant;

a heat exchanger, said heat exchanger being adapted to alternately receive said second high temperature phase of said coolant and said fourth high temperature phase of said coolant, and to extract heat to produce a fifth low temperature phase of said coolant;

a valve system, said valve system being adapted to control a flow of said second and fourth high temperature liquid phases of said coolant to said heat exchanger according to an operational state of said engine, such that said heat exchanger forms an exclusive return path upstream of said engine and downstream of said valve system for said second high temperature phase and said fourth high temperature phase of said coolant.

20. An engine system comprising:

an engine, said engine having a cooling system, said cooling system including a plurality of coolant liquid channels within said engine, said cooling system being adapted to absorb a quantity of waste heat from said engine to produce a first high temperature gas phase of a coolant and a second high temperature liquid phase of said coolant;

a first subsystem, said first subsystem including a converter and a condenser, said converter being adapted to receive said first high temperature gas phase of said coolant and to produce mechanical energy and a third low temperature gas phase of said coolant, said condenser being adapted to receive said low temperature gas phase of said coolant and to extract heat to produce a fourth high temperature liquid phase of said coolant;

a second subsystem, said second subsystem being connected to a cylinder head of said engine, and adapted to receive said second high temperature liquid phase of said coolant;

a heat exchanger, said heat exchanger being adapted to receive said second high temperature phase of said coolant and said fourth high temperature phase of said coolant, and to extract heat to produce a fifth low temperature phase of said coolant;

a valve system, said valve system being coupled to said first and second subsystems, said valve system being adapted to control a flow of said second and fourth high temperature liquid phases of said coolant to said heat exchanger according to an operational state of said engine, such that said heat exchanger forms an exclusive return path upstream of said engine and downstream of said valve system for said second high temperature phase and said fourth high temperature phase of said coolant.

21. An engine system as defined in claim 20 wherein said plurality of coolant liquid channels comprise coolant liquid channels capable of withstanding pressures of at least about five bar in excess of atmospheric pressure.

* * * * *